US005925846A

United States Patent [19]

Richard et al.

[11] Patent Number: 5,925,846

[45] Date of Patent: Jul. 20, 1999

[54] METHOD FOR THE PRODUCTION OF AN AMMONIUM NITRATE FUEL OIL BLASTING COMPOSITION HAVING IMPROVED WATER RESISTANCE

[75] Inventors: Andrew Richard; Grant Simpson; Earl Reckzin, all of North Bay, Canada

[73] Assignee: ETI Canada, North Bay, Canada

[21] Appl. No.: 08/653,966

[22] Filed: May 28, 1996

Related U.S. Application Data

[63] Continuation of application No. 08/327,960, Oct. 24, 1994, abandoned.

[51] Int. Cl.[6] ..... C06B 31/28; C06B 45/00

[52] U.S. Cl. ..... 149/46; 149/112; 149/114; 102/292; 102/289

[58] Field of Search ..... 149/46, 112, 114; 102/292, 289

[56] References Cited

U.S. PATENT DOCUMENTS

| | | | |
|---|---|---|---|
| Re. 33,788 | 1/1992 | Clay | 149/1 |
| 2,590,054 | 3/1952 | Salcats et al. | 52/19 |
| 2,703,528 | 3/1955 | Lee et al. | 102/23 |
| 2,992,912 | 7/1961 | Hradel et al. | 52/14 |
| 3,160,536 | 12/1964 | Aitchison | 149/8 |
| 3,279,965 | 10/1966 | de Raguet | 149/46 |
| 3,297,502 | 1/1967 | Chrisp | 149/6 |
| 3,368,929 | 2/1968 | Bell | 149/46 |
| 3,394,038 | 7/1968 | Minnick et al. . | |
| 3,640,784 | 2/1972 | Yanick et al. | 149/43 |
| 3,823,044 | 7/1974 | Cowan | 149/21 |
| 4,619,721 | 10/1986 | Cescon et al. | 149/21 |
| 4,714,503 | 12/1987 | Cescon et al. | 149/21 |
| 4,736,683 | 4/1988 | Bachman et al. | 102/290 |
| 4,780,156 | 10/1988 | Sheeran et al. | 149/21 |
| 4,889,570 | 12/1989 | Leong | 149/7 |
| 5,041,177 | 8/1991 | Hajto et al. | 149/5 |
| 5,431,757 | 7/1995 | Petterson et al. | 149/46 |
| 5,480,500 | 1/1996 | Richard et al. | 149/46 |

FOREIGN PATENT DOCUMENTS

| | | |
|---|---|---|
| 1143267 | 2/1969 | United Kingdom . |

*Primary Examiner*—Peter A. Nelson
*Attorney, Agent, or Firm*—Bereskin & Parr

[57] ABSTRACT

A method of increasing the water resistance of a blasting explosive comprising an organic carbonaceous fuel, an inorganic oxidizing salt having a particular particle size distribution and a gelling agent comprising the step of adding to the blasting explosive a particulate filler material. The particle size distribution of the particulate filler material and the inorganic oxidizing salt are selected to increase the water resistance of the blasting explosive.

5 Claims, No Drawings

METHOD FOR THE PRODUCTION OF AN AMMONIUM NITRATE FUEL OIL BLASTING COMPOSITION HAVING IMPROVED WATER RESISTANCE

This is a continuation of application Ser. No. 08/327,960 filed Oct. 24, 1994,and now abandoned.

FIELD OF THE INVENTION

This invention relates to the field of explosive compositions comprising organic carbonaceous fuel and an inorganic oxidizing salt. These compositions include ammonium nitrate and fuel oil (hereinafter referred to as "ANFO") blasting explosive compositions. This invention relates to an ANFO explosive composition having improved water resistance.

BACKGROUND TO THE INVENTION

Explosive compositions comprising ammonium nitrate have been widely used throughout the world for many years. As ammonium nitrate is not readily detonatable in and of itself, it is typically mixed with carbonaceous fuels in order to obtain a mixture which is detonatable. Additional compounds such as sensitizers, densifiers, modifiers and surfactants may also be added to an ANFO explosive composition to improve various properties of the explosive composition including the sensitivity to detonation of the explosive, the energy of the explosion and the flowability of the explosive composition.

Typically, explosive compositions containing ammonium nitrate are manufactured at the location where they are to be utilized. For example, an ANFO explosive composition could be prepared at a mine and immediately loaded into a series of boreholes. The ANFO explosive composition would be loaded into the boreholes (typically from about 10 to 15 holes to more than about 100 holes) over a period of days. Typically, an ANFO explosive composition may be kept in a borehole anywhere from one hour up to fourteen days prior to being detonated. If the explosive is a prepackaged explosive composition, then due to shipping and handling time, the explosive composition must be stable for extended periods of time. A prepackaged explosive may also be stored for an extended period of time in a borehole prior to detonation. In some cases, the length of time between mixing the explosive composition and detonation of the explosive composition may be up to ninety days.

After being drilled, a borehole may remain dry for an extended period of time. However, in some cases, water will accumulate in boreholes, such as from the inflow of ground water. ANFO explosive compositions are adversely affected by water penetration and water absorption. Accordingly, if an ANFO explosive composition is loaded into a wet borehole or a borehole into which water subsequently seeps prior to detonation, then the ANFO explosive composition may deflagrate or, in fact, fail to detonate.

One approach which has been utilized to address this problem has been to add guar gum or guar gum and a mixture which includes, for example, sulphur and gilsonite (i.e. ADTEC™) to the ammonium nitrate. One disadvantage of this approach is that excessive amounts of guar gum may be required to obtain a sufficient level of water resistance.

SUMMARY OF THE INVENTION

In accordance with the instant invention, there is provided a method of increasing the water resistance of a blasting explosive comprising an organic carbonaceous fuel, an inorganic oxidizing salt and a gelling agent, the method comprising the step of incorporating particulate filler material as part of the blasting explosive, the particulate filler material having a different particle size distribution from the inorganic oxidizing salt, the particle size distribution of the particulate filler material and the particle size distribution of the inorganic oxidizing salt being selected to increase the water resistance of the blasting explosive. The particulate filler material may be incorporated into the blasting explosive by mixing the particulate filler material, inorganic oxidizing salt, fuel oil and gelling agent together in any order.

The particulate filler material may be selected so as to enhance the explosive force of the explosive composition. For example, the particulate material may be an inorganic oxidizing salt, aluminum flakes, aluminum granules or a mixture thereof. Preferably, the filler material is ammonium nitrate and, most preferably, the particulate material comprises miniprills.

Preferably, the inorganic oxidizing salt comprises ammonium nitrate. The organic carbonaceous fuel is preferably fuel oil, such as No. 2 fuel oil.

It is preferred that the organic carbonaceous fuel is present in an amount from about 2 to about 10 wt. % based upon the weight of the inorganic oxidizing salt and the fuel. More preferably, the organic carbonaceous fuel is present in an amount from about 4 to about 8 wt. % and, most preferably, the ratio of inorganic oxidizing salt to organic carbonaceous fuel is about 94:6. The explosive composition when loaded into a borehole is a sensitized blend of inorganic oxidizing salt, organic carbonaceous fuel and gelling agent.

The gelling agent may be selected from any of those which are currently used in the industry. The gelling agent is preferably guar gum, such as a cold temperature hydrating guar gum. The guar gum may be self cross-linking.

The constituents of the particulate filler material preferably have a smaller particle size than the inorganic oxidizing salt particles. The particulate filler material will situate itself in interstitial spaces between the inorganic oxidizing salt particles. Accordingly, the particulate filler material decreases the voidage of the ammonium nitrate/particulate filler material mixture.

The particle size distribution of the particulate filler material and the inorganic oxidizing salt may be mutually selected to produce an explosive composition which is sensitized and has increased water resistance. Alternately, the particle size distribution, and the quantity of, the particulate filler material may be selected, in view of the characteristics of an ANFO explosive composition, to produce an explosive composition having increased water resistance. For example, in one embodiment, the explosive composition may be an ANFO explosive to which miniprills are added. The miniprills may be added to an existing ANFO explosive composition or, alternately, the miniprills may be added to the ammonium nitrate prior to the production of the ANFO explosive composition.

The ANFO explosive composition may comprise from about 5 to about 50% miniprills, more preferably from about 5 to about 30% miniprills and, most preferably about 30% miniprills, based upon a weight of the ammonium nitrate. This produces an explosive composition having a wider particle size distribution and a decreased voidage.

In another embodiment, instead of adding a particulate filler material such as miniprills to the ammonium nitrate, ammonium nitrate may be passed through a plurality of sieves to provide ammonium nitrate for incorporation into an ANFO explosive composition wherein the particle size distribution of the ammonium nitrate has been selected to increase the water resistance of the blasting explosive.

In a further embodiment, the prill manufacturing process, eg. the operating parameters of the prilling tower, may be adjusted to produce ammonium nitrate having a particle size distribution which is selected to increase the water resistance of the blasting explosive.

DESCRIPTION OF THE PREFERRED EMBODIMENT

The explosive composition of the present invention comprises an explosive mixture of organic carbonaceous fuel and inorganic oxidizing salts.

The organic carbonaceous fuel may be selected from any fuel known in the art. The fuel may be a solid (e.g. a wax) or a liquid (e.g. fuel oil, heating oil, diesel fuel, jet fuel, kerosene, mineral oils, saturated fatty acids such as lauric acid and stearic acid, alcohols such as cetyl alcohol, corn oil, soy bean oil and the like) or a mixture of solid and liquid fuels. Such fuels may also be supplemented with fuel-soluble ingredients such as glucose, mannose, fructose, waxes, such as microcrystalline wax, paraffin wax, petroleum wax and the like. Preferably, the organic carbonaceous fuel comprises fuel oil, such as No. 2 fuel oil.

The inorganic oxidizing salt may comprise ammonium nitrate. The ammonium nitrate is in the form of separate discrete particles, such as prills, granules, pellets and/or fines as opposed to cast or powdered ammonium nitrate or solutions thereof. Particulate ammonium nitrate suitable in ANFO blasting explosive compositions are known in the art.

The size of the ammonium nitrate particles may be sufficiently small to pass through a 6 Tyler™ sieve but sufficiently large so that most particles are retained on a 35 Tyler sieve. Typically, ammonium nitrate used in explosive compositions comprises particles wherein about 95% or more pass through a Tyler 6 sieve but are retained on a 35 Tyler™ sieve. Typically, such prills have a particle density of from about 1.35 g/cc to about 1.5 g/cc and a poured density of 0.7 g/cc to 0.85 g/cc, preferably from about 0.75 g/cc to about 0.85 g/cc. In the trade, such porous ammonium nitrate particles are known as prilled ammonium nitrate.

A portion of the ammonium nitrate component may be replaced by other inorganic oxidizer salts known in the art including alkali metal nitrates and perchlorates (such as sodium nitrate and potassium nitrate) or alkaline-earth metal nitrates and perchlorates (such as calcium nitrate, magnesium nitrate and barium nitrate). These additional components may be added in an amount from about 0 to about 20 wt. % and, more preferably from about 0 to about 15 wt. % based upon the weight of the ammonium nitrate particles.

It is preferred that the organic carbonaceous fuel is present in an amount from about 2 to about 10 wt. % based upon the weight of the carbonaceous fuel and inorganic oxidizing salts. More preferably, the organic carbonaceous fuel is present in an amount from about 4 to about 8 wt. % and, most preferably, the ratio of inorganic oxidizing salts to carbonaceous fuel is about 94:6.

The explosive composition of the present invention contains sufficient organic carbonaceous fuel so that the explosive composition is essentially oxygen balanced, taking into consideration the total oxidizing salts, fuel, sensitizers and other additives present in the explosive. Preferably the blend has an oxygen balance more positive than about −25% and, more preferably, in the range of about −10 to +10%.

The inorganic oxidizing salt particles are mixed with a gelling agent. The gelling agent swells or hydrates upon contact with water, such as the water which may be present in a borehole or which may flow into a borehole, forming a gel. The gel acts as a barrier which prevents, or at least reduces, the absorption of water by the inorganic oxidizing salt particles. The gelling agent may be any of those known in the art. Guar gum is the preferred gelling agent. However, other agents such as polyacrylamide, carboxy methyl or ethyl cellulose, biopolymers such as xanthan gum or derivatives of guar gum such as hydroxyethyl or hydroxypropyl guar can be employed. Further, the guar gum may be self cross-linking or a suitable crosslinker for the gelling agent, such as, for example, potassium pyroantimonate, boric acid, ferric chloride or other heavy metal compounds can be added as desired or these compounds may be present in the guar gum. Alternately, guar gum and a mixture which includes, for example, sulphur and gilsonite (i.e. ADTEC™) may be used.

Generally, the gelling agent will be present in an amount from about 0.1 to about 10 wt. % based upon the weight of the explosive composition, and more preferably, from about 5 to about 10 wt. %.

In one embodiment, the explosive composition further includes particulate filler material. The particulate filler material may be made from any compound which would not have a deleterious effect on the explosive composition. Accordingly, the particulate filler material may be an inert substance which produces a neutral effect on the force of the explosion on detonation of the explosive composition. Alternately, the particulate filler material may be an active ingredient which would act as a fuel increasing the force of the explosive composition. Accordingly, the particulate filler material preferably comprises an inorganic oxidizing salt, aluminum flake, granular aluminum or mixtures thereof and, most preferably, ammonium nitrate.

The particulate filler material is sized to fill at least a portion of the interstitial spaces between the inorganic oxidizing salt particles. If too high a percentage of the interstitial spaces are filled, then the sensitivity of the explosive composition is reduced. Generally, the particle size of typical ammonium nitrate prills which are utilized to manufacture ANFO explosive compositions have a prill size between Tyler 6 and 35, with over 90 wt % of the prills being retained on a sieve size of Tyler 10 or 14. Accordingly, the particle size of a substantial portion of the particulate filler material preferably passes through Tyler 14 sieve. For example more than about 50 wt. % of the particulate filler material may be retained on Tyler sieve sizes 20, 28 or less, preferably more than about 70 wt. % and most preferably about 80–90 wt. %. Accordingly, the particle size distribution of the ammonium nitrate and the particulate filler material may be bimodal.

By combining the particulate filler material and the ammonium nitrate prills, the solid particles of the explosive composition (namely the ammonium nitrate and the particulate filler material) may comprise from about 15 to about 60 wt. % particles which are retained on a Tyler 10 sieve, from about 15 to about 60 wt. % particles which are retained on a Tyler 14 sieve and from about 20 to about 60 wt. % particles which are retained on a Tyler 20 sieve. Preferably, from about 25 to about 60 wt. % of the particles are retained on a Tyler 10 sieve, from about 15 to about 45 wt. % of the particles are retained on a Tyler 14 sieve and from about 20 to about 40 wt. % of the particles are retained on a Tyler 20 sieve. Most preferably, from about 35 to about 50 wt. % of the particles are retained on a Tyler 10 sieve, from about 20 to about 40 wt. % of the particles are retained on a Tyler 14 sieve and from about 20 to about 40 wt. % of the particles are retained on a Tyler 20 sieve.

As discussed above, the average particle size of the filler material is generally less than the average particle size of the inorganic oxidizing salt. The ratio of average particle size of the particulate filler material to the inorganic oxidizing salt may be from about 0.3:1 to about 0.8:1 and, preferably from about 0.5:1 to about 0.6:1. At this level, at least some of the particulate filler material fits within the interstitial spaces of the inorganic oxidizing salt particles and accordingly decreases the voidage thereof.

A particularly preferred particulate filler material comprises miniprills. Miniprills are particulate ammonium nitrate particles wherein, generally, at least about 95 wt. % of the particles pass through a 12 Tyler screen mesh size and at least about 95% of the particles are retained on a 28 Tyler screen mesh. The particle size of at least 95% of the ammonium nitrate miniprills will preferably range from about 0.4 mm to about 2.4 mm and, more preferably, from about 0.6 mm to about 1.4 mm. Miniprills typically have a high density which may range from about 0.85 to about 1.05 g/cc, preferably, from about 0.90 to about 1.0 g/cc, and most preferably, about 0.95 g/cc, as determined by weighing an untapped sample of the prills in a container of known volume. Miniprills may be prepared by conventional means, such as spraying molten ammonium nitrate containing very little moisture (e.g 0.1 to 0.4 wt. % water and preferably less than 0.2 wt. % water) at elevated temperature (e.g. 175° C. or higher) into a prilling tower countercurent to cooling air which solidifies the droplets into prills which are ultimately cooled to ambient temperature. This results in the production of miniprills which are generally round.

The explosive composition may comprise from about 5 to about 50% miniprills, more preferably from about 5 to about 30% miniprills and, most preferably about 30% miniprills, based upon a weight of the ammonium nitrate.

The ability of the particulate filler material to fill the interstitial spaces of the inorganic oxidizing salt is enhanced if the shape of the inorganic oxidizing salt particles and the particulate filler material are complimentary. For example, if the inorganic oxidizing salt particles are generally round in shape (e.g. ammonium nitrate prills), then the use of particulate filler material which is generally round in shape, such as miniprills prepared in a prilling tower, is preferably utilized. It will be appreciated that if the inorganic oxidizing salt particles are of a different shape, then the complimentary shape of the particulate filler material will vary.

The particulate filler material may be incorporated into the blasting explosive by mixing the particulate filler material, inorganic oxidizing salt, fuel oil and gelling agent together in any order. The particulate filler material is preferably mixed with the inorganic oxidizing salt. The mixture of ammonium nitrate and particulate filler material may then be mixed with the fuel oil to produce a sensitized blasting explosive composition. This composition may then be mixed with the gelling agent to produce the blasting explosive of the instant invention. Alternately, the inorganic oxidizing salt, the fuel oil and the gelling agent may be mixed in any manner known in the art to produce a sensitized blasting explosive and the particulate filler material may then be added to the blasting explosive to produce the blasting explosive of the instant invention having improved water resistance. Alternately, the particulate filler material may be added at an intermediate stage.

The forgoing discussion has been premised upon the assumption that the particulate filler material is selected based upon the analysis of the shape and size of an existing supply of inorganic oxidizing salt particles. This may particularly be the case, for example, where a manufacturer of explosive compositions had an existing inventory of ammonium nitrate particles but intends to produce and ANFO requiring enhanced water resistance. In such a case, the manufacturer may accordingly locate a source of particulate filler material, e.g. miniprills, having the desired shape and size distribution to produce an explosive composition according to the instant invention having improved water resistance.

Alternately, for example if the manufacturer does not have an inventory of ammonium nitrate, an explosive composition according to the instant invention may be prepared by mutually selecting the size and shape of the inorganic oxidizing salt particles and the filler material.

It will also be appreciated that an appropriate size distribution of ammonium nitrate particles may be prepared, not by mixing ammonium nitrate and particulate filler material together, but by producing ammonium nitrate particles having a particle size distribution such as that which would be obtained by mixing together ammonium nitrate particles and miniprills. Thus ammonium nitrate having a decreased voidage would be directly produced. This may be achieved by screening ammonium nitrate particles to produce particles having a particle size distribution similar to that which is achieved by mixing conventional ammonium nitrate particles and miniprills.

In a further embodiment, the prill manufacturing process, eg. the operating parameters of the prilling tower, may be adjusted to produce ammonium nitrate having a particle size distribution which is selected to increase the water resistance of the blasting explosive (e.g. particles having a particle size distribution similar to that which is achieved by mixing conventional ammonium nitrate particles and miniprills).

The invention will be further understood by the following examples which are not to be construed as a limitation on the invention. Those skilled in the art will appreciate that other and further embodiments are obvious and within the spirit and scope of this invention from the teachings of the present examples taken with the accompanying specifications.

EXAMPLE 1

Various explosive compositions were prepared using two different sets of ammonium nitrate particles and commercially available ammonium nitrate miniprills which were manufactured by Sheritt Inc. The miniprills had a untapped bulk density of 0.90 g/cc. The particle size distribution of the ammonium nitrate particles and the miniprills is set out in Table 1.

TABLE 1

PARTICLE SIZE DISTRIBUTION

| TYLER MESH SIZE | Particle Set A (%) | Particle Set B (%) | MINIPRILLS (%) |
|---|---|---|---|
| 6 | 0 | 0 | 0 |
| 10 | 63.5 | 82 | 1 |
| 14 | 21.5 | 14 | 20 |
| 20 | 14.6 | 4 | 68 |
| 35 | 2 | 0 | 11 |
| Through 35 | 2 | 0 | 0 |

The following mixtures of ammonium nitrate particles and miniprills were prepared. The particle size distribution of these mixtures are set out in Table 2. In total, the following mixtures were prepared.

Run No. 1: 10% miniprills and 90% particle set A
Run No. 2: 20% miniprills and 80% particle set A
Run No. 3: 30% miniprills and 70% particle set A
Run No. 4: 40% miniprills and 60% particle set A
Run No. 5: 50% miniprills and 50% particle set A
Run No. 6: 10% miniprills and 90% particle set B

TABLE 2

PARTICLE SIZE DISTRIRUTION OF MIXTURES

| TYLER MESH SIZE | RUN NO. 1 | RUN NO. 2 | RUN NO. 3 | RUN NO. 4 | RUN NO. 5 | RUN NO. 6 |
|---|---|---|---|---|---|---|
| 6 | 0.00 | 0.00 | 0.00 | 0.00 | 0.00 | 0.00 |
| 10 | 57.26 | 51.00 | 44.75 | 38.50 | 32.25 | 73.91 |
| 14 | 21.35 | 21.20 | 21.05 | 20.90 | 20.75 | 14.60 |
| 20 | 9.94 | 25.28 | 30.62 | 35.96 | 41.30 | 10.39 |
| 35 | 1.28 | 2.36 | 3.44 | 4.52 | 5.60 | 1.10 |
| Through 35 | 0.18 | 0.16 | 0.14 | 0.12 | 0.10 | 0.00 |

As can be seen from Table 2, the addition of even 10% of miniprills produces a wider particle size distribution. This reflects the fact that the mixture of Run No. 1 would have a smaller voidage. The wider particle size distribution results in a surprising increase in water resistance.

EXAMPLE 2

Explosive compositions were prepared using the ammonium nitrate and miniprills of Example 1. In particular, an explosive composition was prepared by mixing particle set A and fuel oil in a weight ratio of 94:6. This ANFO mixture was then mixed with 7 wt. % guar gum. Similarly, explosive mixtures were prepared using particle set B and the ammonium nitrate/miniprill mixtures of Run Nos. 1 & 6.

The water resistance of the these explosive compositions was then measured according to the following procedure. The required density of the explosive composition was first selected. A sufficient weight of ANFO blasting explosive was then placed into a 1,000 ml graduated cylinder. The cylinder was gently tapped until the contents were level with the 1,000 ml mark. 100 ml of cold tap water was poured into the centre area of the ANFO blasting explosive in the 1,000 ml graduated cylinder. The water was gently poured over the top of the ANFO for a period of about 15 seconds. The ANFO and water was then allowed to stand for one hour. At the end of the hour, the deepest penetration of the liquid in the 1,000 ml graduated cylinder was measured. The results are set out in Table 3.

TABLE 3

DEPTH OF WATER PENETRATION

| EXPLOSIVE MIXTURE | DEPTH (cm) |
|---|---|
| Particle set A | 11 |
| Run No. 1 | 5.5 |
| Particle set B | 24.5 |
| Run No. 6 | 16 |

As can be seen from the forgoing table, the addition of 10% miniprills to each of particle sets A and B resulted in an explosive composition having improved water resistance. With respect to particle set A, the depth of water penetration decreased from 11 cm to 5.4 cm and, with respect to the particle set B, the penetration decreased from 24.5 to 16 cm.

EXAMPLE 3

In order to further illustrate the performance of the explosive composition containing miniprills, the water absorption of the explosive composition was measured. Accordingly, after the depth of water penetration was measured for Example No. 2, the water remaining on the top of the explosive composition in the 1,000 ml graduated cylinder was poured off and the volume measured in a 100 ml graduated cylinder. The explosive composition prepared using only the ammonium nitrate particles of particle set A absorbed 80 ml of water. Accordingly, only 20 ml of water was poured off. However, the explosive composition of Run No. 1, which contained 10% miniprills mixed with the ammonium nitrate of particle set A, absorbed only 40 ml of water. Accordingly, 60 ml of water was poured off. Once again, it can be seen that the small addition of miniprills to conventional AN prills resulted in a 50% reduction in the amount of water absorbed by the explosive composition.

We claim:

1. The use of a particulate filler material in a blasting explosive comprising an organic carbonaceous fuel comprising fuel oil, an inorganic oxidizing salt comprising ammonium nitrate and a gelling agent present in an amount from about 0.1 wt % to about 10 wt. % based on the weight of said explosive composition to reduce the voidage in the blasting explosive and increase the water resistance of the blasting explosive, said particulate filler material comprising ammonium nitrate miniprills.

2. The use of particulate filler material as claimed in claim 1 wherein the ratio of the average particle size of the particulate filler material to the average particle size of the inorganic oxidizing salt is from about 0.3:1 to about 0.8:1.

3. The use of particulate filler material as claimed in claim 1 wherein the ratio of the average particle size of the particulate filler material to the average particle size of the inorganic oxidizing salt is from about 0.5:1 to about 0.6:1.

4. The use of particulate filler material as claimed in claim 1 wherein said explosive composition comprises from about 5 to about 50% particulate filler material.

5. In a method of producing a blasting explosive comprising manufacturing an inorganic oxidizing salt including ammonium nitrate having a particular particle size distribution and mixing said inorganic oxidizing salt with an organic carbonaceous fuel including fuel oil and a gelling agent to produce said blasting explosive, the step of adjusting the particle size distribution of said inorganic oxidizing salt produced by said manufacturing step to produce a blasting explosive having improved water resistance, said explosive composition comprising from about 0.1 wt. % to about 10 wt. % gelling agent and from about 5 to about 50% miniprills.

* * * * *